US008032053B2

(12) United States Patent
Atwood et al.

(10) Patent No.: US 8,032,053 B2
(45) Date of Patent: Oct. 4, 2011

(54) DRAWER LATCH FLEXURE MECHANISM

(75) Inventors: Mark A. Atwood, Rush, NY (US); Joseph M. Wing, Ontario, NY (US); Michael L. Gumina, Walworth, NY (US); Brian J. Perry, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 797 days.

(21) Appl. No.: 12/128,800

(22) Filed: May 29, 2008

(65) Prior Publication Data

US 2011/0076054 A1 Mar. 31, 2011

(51) Int. Cl.
*G03G 15/00* (2006.01)

(52) U.S. Cl. ..... 399/110; 312/333; 399/107

(58) Field of Classification Search ..... 399/110, 399/107, 111, 125; 292/1, 358; 312/215, 312/222, 333

See application file for complete search history.

(56) References Cited

U.S. PATENT DOCUMENTS

| | | | | |
|---|---|---|---|---|
| 4,303,216 | A | 12/1981 | Hollingsead | |
| 5,112,012 | A | 5/1992 | Yuan et al. | |
| 5,150,166 | A * | 9/1992 | Matsuura et al. | 399/110 |
| 5,926,671 | A * | 7/1999 | Leibman | 399/110 |
| 6,032,004 | A | 2/2000 | Mirabella, Jr. et al. | |
| 6,574,097 | B2 | 6/2003 | Hood, III et al. | |
| 6,674,641 | B2 | 1/2004 | Jensen et al. | |
| 7,216,665 | B1 | 5/2007 | Sims, Jr. | |
| 7,274,897 | B2 * | 9/2007 | Katoh | 399/110 X |
| 7,454,159 | B2 * | 11/2008 | Parks et al. | 399/107 X |
| 2004/0076447 | A1 * | 4/2004 | Matsuo et al. | 399/110 |

* cited by examiner

*Primary Examiner* — Sophia S Chen
(74) *Attorney, Agent, or Firm* — Gibb I.P. Law Firm, LLC

(57) ABSTRACT

A latch apparatus has a latch base, a latch frame, and at least one flexible bracket connecting the latch frame to the latch base. Connectors are used to connect the flexible bracket to the latch frame and connect the flexible bracket to the latch base. The connectors prevent the outer surface of the flexible bracket from moving along the surface of the latch frame or the surface of the latch base. A biasing member is connected to the latch base and the latch frame. The flexible bracket maintains a gap between the latch base and the latch frame and prevents the latch base from contacting or sliding along the latch frame.

20 Claims, 7 Drawing Sheets

DRAWER LATCH FLEXURE MECHANISM

BACKGROUND AND SUMMARY

Embodiments herein generally relate a latch apparatus, and more particularly to a latch apparatus that connects a latch frame to a latch base and allows the latch base to move relative to the latch frame.

In mechanical devices, drawers are often utilized for various purposes, such as to maintain items and/or allow internal items to be accessed. For example, in printing devices, drawers are often utilized to maintain functional components or modules at appropriate positions and/or locations so that the components can perform their respective operations.

However, one issue that is encountered when utilizing such mechanisms is that the latches of the drawers may not operate properly if they become contaminated with foreign matter. For example, an excessive amount of foreign matter may prevent the latch mechanism from properly opening and/or closing. The embodiments described herein address such issues.

More specifically, one embodiment comprises a latch apparatus that has a latch base, a latch frame, and at least one flexible bracket connecting the latch frame to the latch base. Connectors are used to connect the flexible bracket to the latch frame and connect the flexible bracket to the latch base. The connectors prevent the outer surface of the flexible bracket from moving along the surface of the latch frame or the surface of the latch base.

The shape of the flexible bracket comprises a ribbon of flexible material shaped to have four equally spaced 90 degree bends. The ribbon of flexible material has a width approximately at lease 10 times greater that a thickness of the ribbon of flexible material. The flexible bracket can comprise any flexible material, such as a metal, an alloy, a polymer, a plastic or rubber.

The flexible bracket flexes in a "first" direction when the latch frame moves relative to the latch base. The flexible bracket biases a relative position between the latch base and the latch frame to a predetermined centralized position. A biasing member is connected to the latch base and the latch frame. The biasing member biases the latch frame in a first direction parallel to the longitudinal axis of the latch frame. The flexible bracket has a shape that allows the flexible bracket to have greater flexibility in the first direction parallel to the longitudinal axis of the latch frame and lesser flexibility in a second direction that is substantially perpendicular to the first direction. The flexible bracket maintains a gap between the latch base and the latch frame and prevents the latch base from contacting or sliding along the latch frame.

Therefore, embodiments herein use a flexible bracket to eliminate sliding surfaces within latches. The structures described herein are especially useful with latches that find application in highly contaminated environments, such as those environments experienced within printing devices. The flexible brackets described herein create a gap between surfaces that would otherwise slide against each other; yet the flexible brackets allow parts that need to move to have a sufficient movement to perform their intended function. Further, the embodiments described herein allow the flexible bracket to provide some of the latching force required, thereby allowing the biasing device that is used to create the latching force to be smaller, less expensive, lighter, etc. These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, one issue that is encountered when utilizing such mechanisms is that the latches of the drawers may not operate properly if they become contaminated with foreign matter. This issue is of concern especially for devices that operate within a fairly contaminated and environment, such as printers and printing devices whose internal components are often exposed to toner powder and paper debris particles. For example, if a latch were to be located in the bottom of the photoreceptor development area, it could be exposed to a great deal of contamination. This contamination can work its way into the components that slide against each other and causes binding. This can create non-uniform latch forces and place high stress on welded joints leading to occasional part failure.

Figure 1:
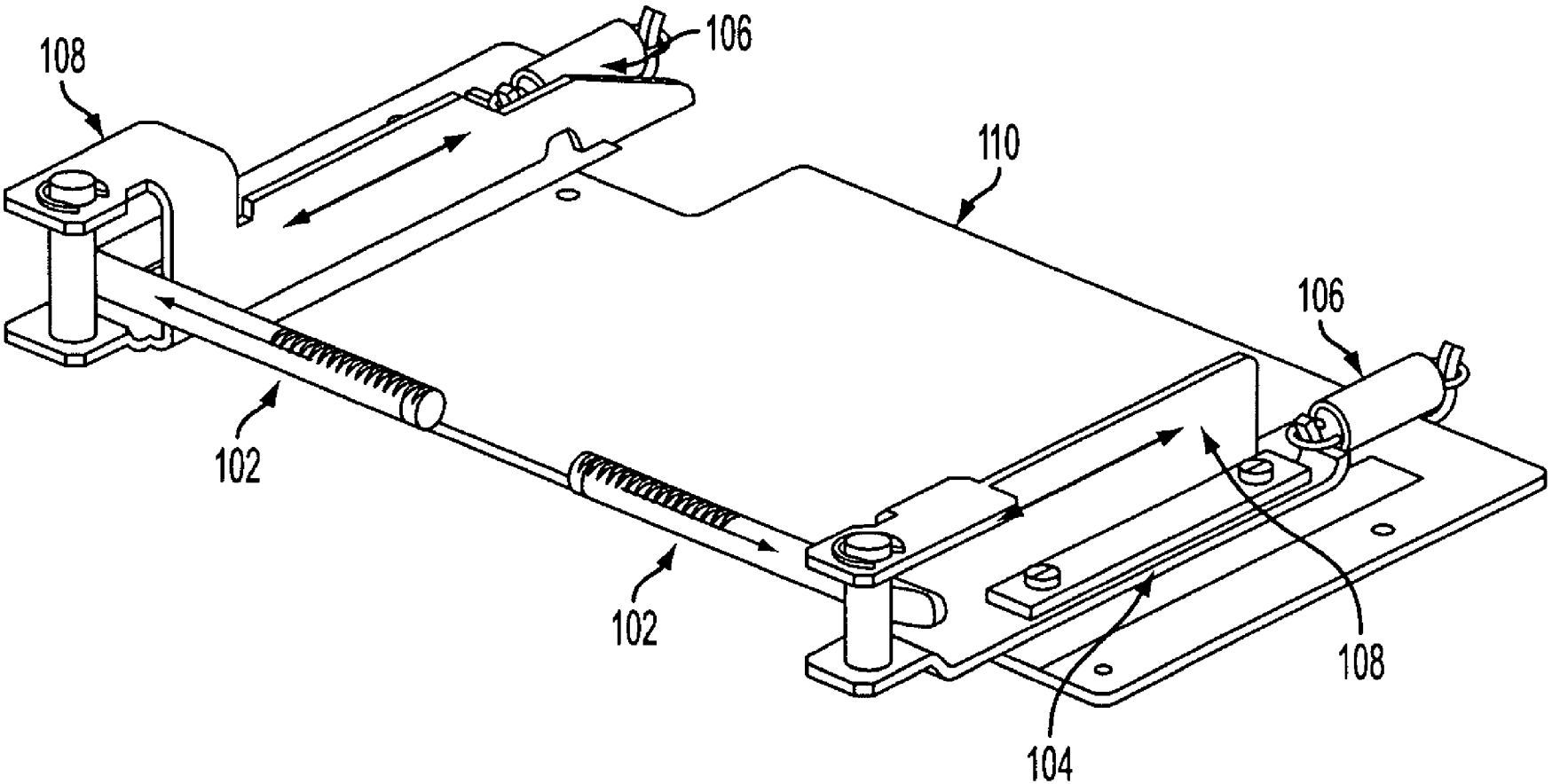
FIG. 1 is a perspective view schematic diagram illustrating a spring biased latch mechanism.

FIG. 1 illustrates a latch structure that is not necessarily conventionally well-known. As shown in FIG. 1, pawls 102 are rigidly held in place and driven outwards, which in turn pulls the brackets (which make up part of the latch frame) 108 forward, generating the latch force. More specifically, in the structure shown in FIG. 1 the pawls 102 comprise ram or cam shaped ends that pull on the two sheet metal brackets 108 that make up the latch frame and that slide on a plastic film 104 adhered to a base plate 110, which is sometimes referred to herein as the latch base 110. Attached to the latch frame 108 parts are extension springs 106 which provide the latch force required.

If excessive contamination exists between the latch frame 108 and the plastic film 104, one undesirable outcome is high lateral loading, which places additional stress on the design. The latch force is generated by extension springs 106. The latch frame 108 slide on a thin film 104 on the base 110. However, the area between the latch frame 108 and the thin film 104 is easily penetrated or worn through by sharp edges and debris.

Figure 2:
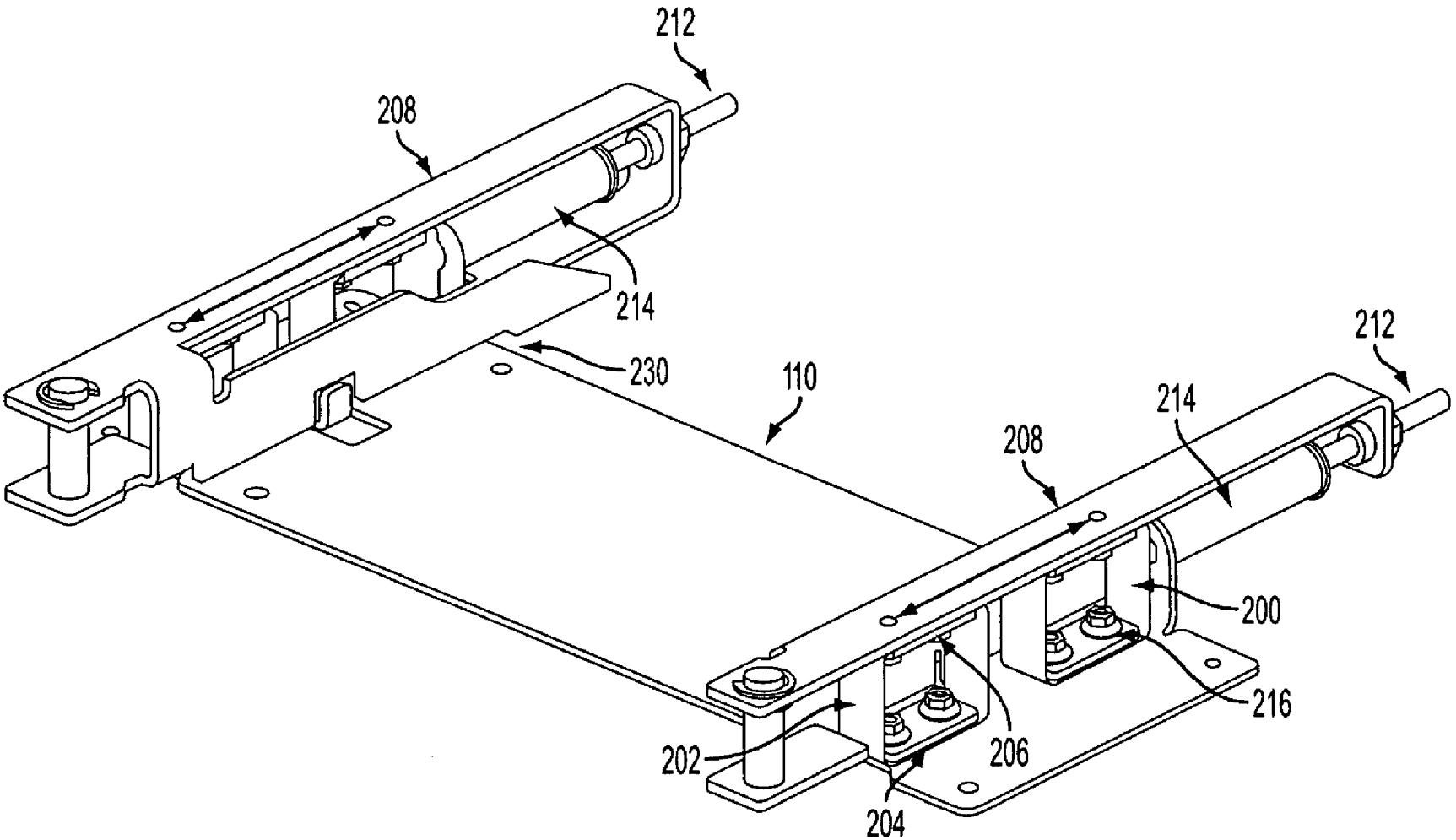
FIG. 2 is a perspective view schematic diagram illustrating a flexible bracket latch mechanism according to embodiments herein.

The structure shown in FIG. 2 is different from the structure shown in FIG. 1 and includes flexible brackets 200 (that could be a pair of box type flat springs that avoid the need for the latch frame 208 to slide on the thin-film 104. In the structure shown in FIG. 2, the latch frame 208 is separated from the latch base 110 by a gap 230 created by the flexible brackets 200. Thus, the latch frame 208 is supported by a pair of box type flat springs that act as flexures.

More specifically, FIG. 2 illustrates the latch base 110, a latch frame 208, and at least one flexible bracket 200 connecting the latch frame 208 to the latch base 110. The pawls 102 are also utilized with the structure shown in FIG. 2, but are not illustrated so as to more clearly show the features in FIG. 2. The shape of the flexible bracket 200 comprises a ribbon of flexible material having four equally spaced 90 degree bends. The ribbon of flexible material has a width approximately at lease 10 times greater that a thickness of the ribbon of flexible material.

Connectors 216 are used to connect the flexible bracket 200 to the latch frame 208 and to the latch base 110. The connectors 216 prevent the outer surface of the flexible bracket 200 from moving along the surface of the latch frame 208 or the surface of the latch base 110. Therefore, the flexible bracket 200 can maintain a gap between the latch base 110 and the latch frame 208 and prevent the latch base 110 from contacting or sliding along the latch frame 208. Because all sliding interfaces have been eliminated from the design shown in FIG. 2, such a structure is robust against any amount of contamination.

The flexible bracket 200 flexes in one direction (a "first" direction that is illustrated by the arrows in FIG. 2) when the latch frame 208 moves relative to the latch base 110. As shown in greater detail in FIGS. 3 and 4, the flexible box-shaped springs 200 attach the frame 208 to the base 110. More specifically, the base 204 of each of the flexible brackets 200 is clamped to the base plate 110 while the sides 202 of the flexible brackets 200 are free to flex. The top portion 206 of the each of the flexible brackets 200 is clamped to the latch frame 208 leaving the vertical sections 202 of the flexible brackets 200 free to flex.

Referring again to FIG. 2, a biasing member 214 (such as compression or coil spring, or any similar biasing device such as pneumatic cylinders, etc.) is connected to each bracket member of the latch base 110 and the latch frame 208. Thus, the biasing member 214 biases the latch frame 208 in the first direction (that is parallel to the longitudinal axis of the latch frame 208). The latch force can be adjusted by adjusting the screws 212 acting on the compression springs 214.

Figure 3:
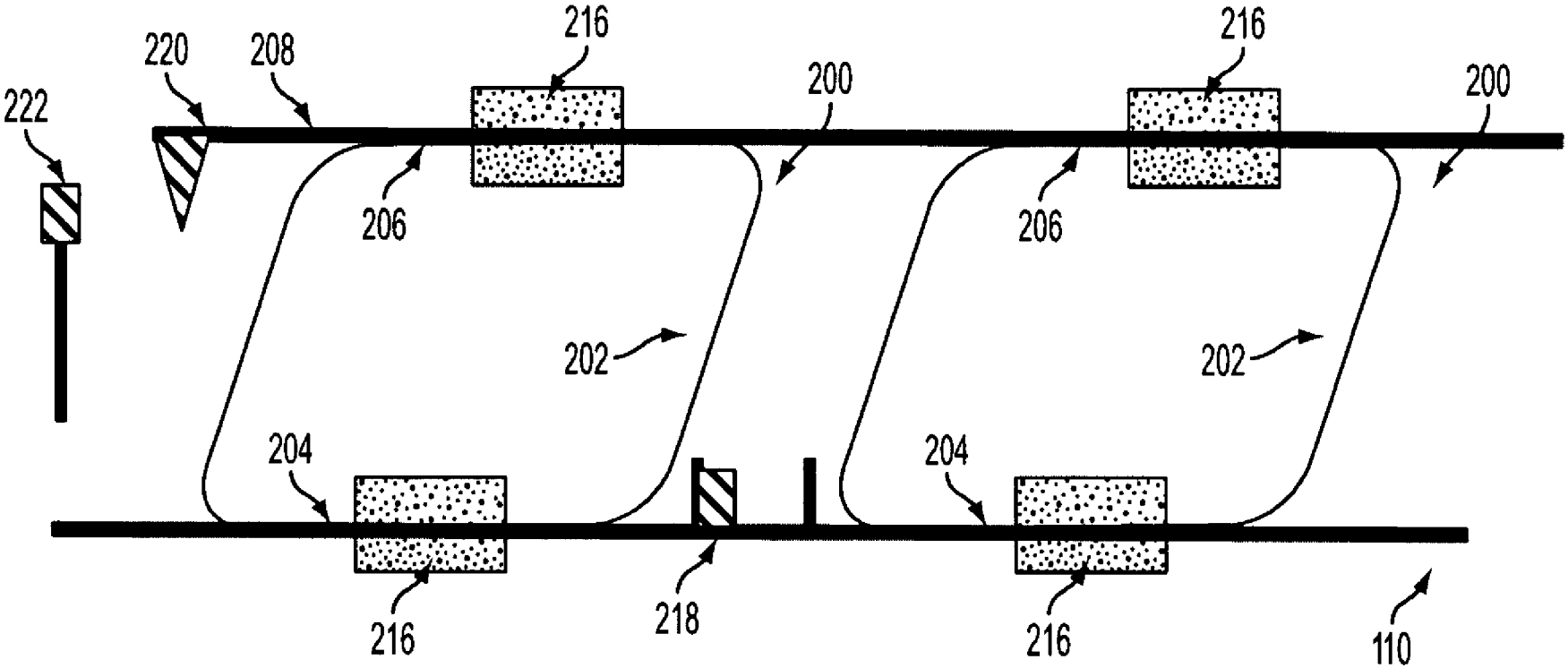
FIG. 3 is a cross-sectional view schematic diagram illustrating a flexible bracket latch mechanism according to embodiments herein.
Figure 4:
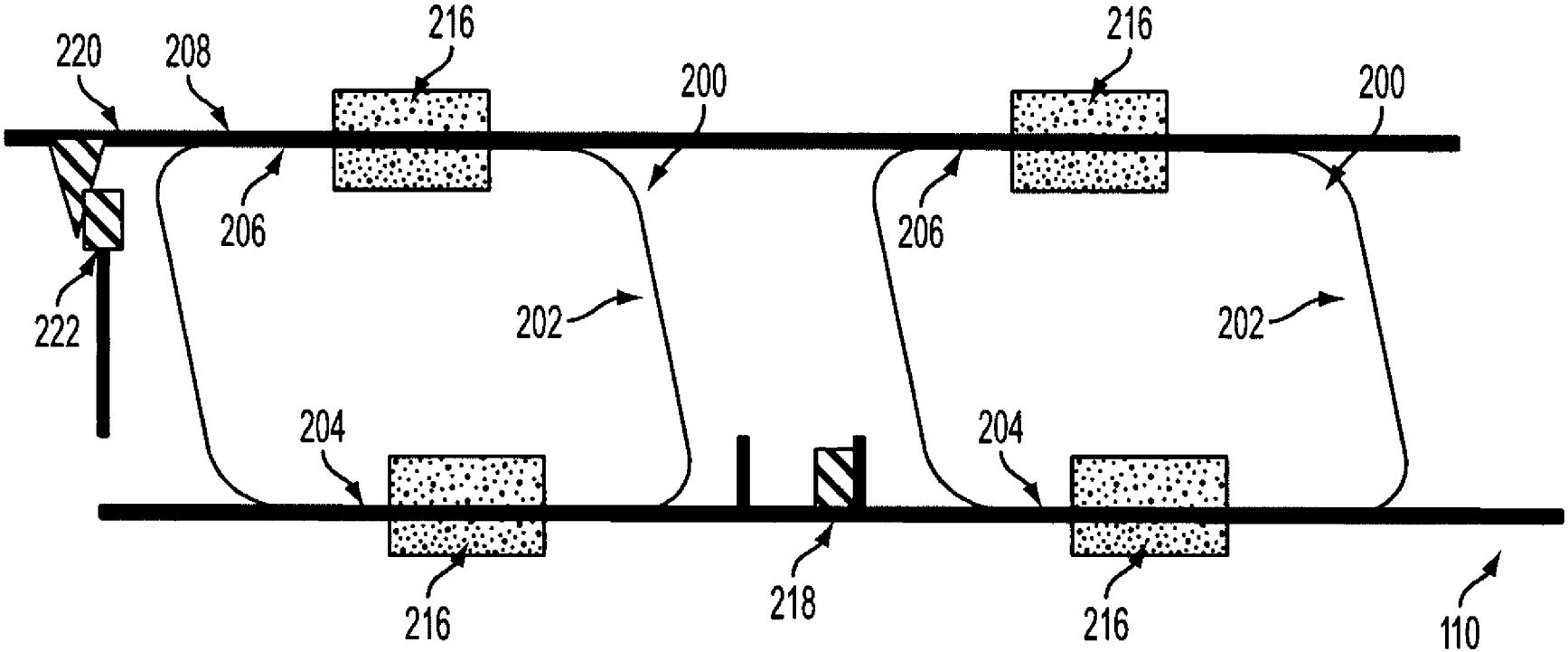
FIG. 4 is a cross-sectional view schematic diagram illustrating a flexible bracket latch mechanism according to embodiments herein.

FIG. 3 illustrates the structure in the unlatched position, where the position of the latch frame 208 is shifted relative to the position of the latch base 110 from a central predetermined position. FIG. 4 illustrates the structure in the latched position, where the position of the latch frame 208 is shifted relative to the position of the latch base 110 from a central predetermined position. In the latched position shown in FIG. 4, a catch 220 connected to the latch framework 208 is blocked by a bracket 222, which maintains the latch structure in the latched position and limits the movement of the latch frame 208 with respect to the latch base 110.

When in the central predetermined position, the flexible brackets 200 would not be acted upon by the force of the biasing members 214 or the catch 220 and would appear as squares or rectangles in cross-section, and would not be biased to either side. The amount of movement between the latch frame 208 and the latch base 110 is also limited by a stop 218.

The flexible bracket 200 biases the relative position between the latch base 110 and the latch frame 208 to a predetermined centralized position. Thus, depending upon the flexibility of the flexible brackets, the flexible brackets can provide a substantial amount (e.g., 10%, 25%, 50%, 75%, etc.) of the latch force required, thereby allowing the biasing members 214 to be less expensive, lighter, smaller, etc. For example, the flexible bracket 200 can comprise any flexible material, such as a metal, an alloy, a polymer, a plastic or rubber.

Figure 5:
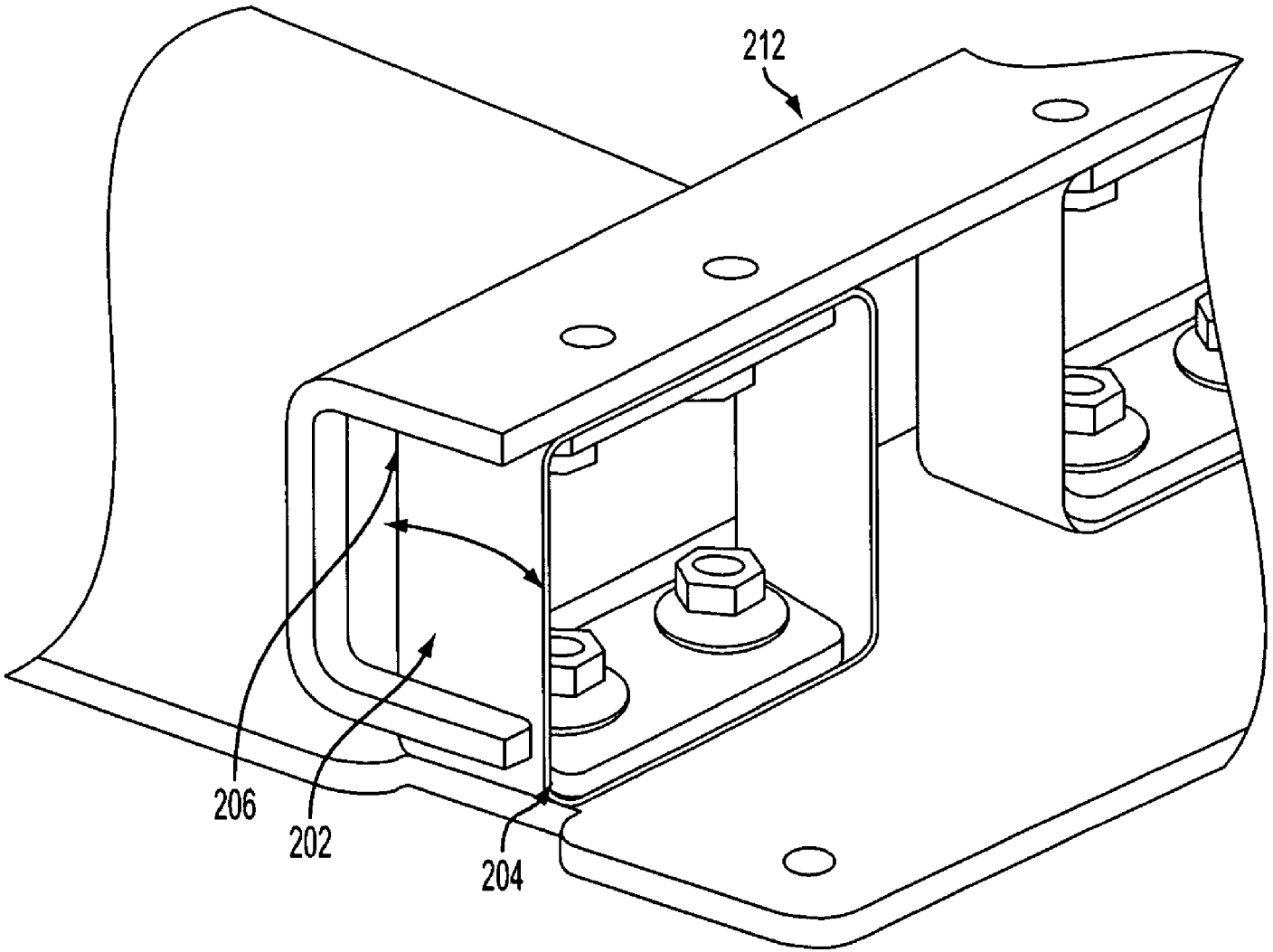
FIG. 5 is a perspective view schematic diagram illustrating a flexible bracket latch mechanism according to embodiments herein.

The flexible bracket 200 has a shape that allows the flexible bracket 200 to have greater flexibility in the first direction parallel to the longitudinal axis of the latch frame 208 and lesser flexibility in a second direction that is substantially perpendicular to the first direction, as shown by the arrow in FIG. 5. The shape of the flexible brackets 200 allows the brackets 200 to travel in the axial direction but resist lateral motion when side loads are applied.

Figure 6:
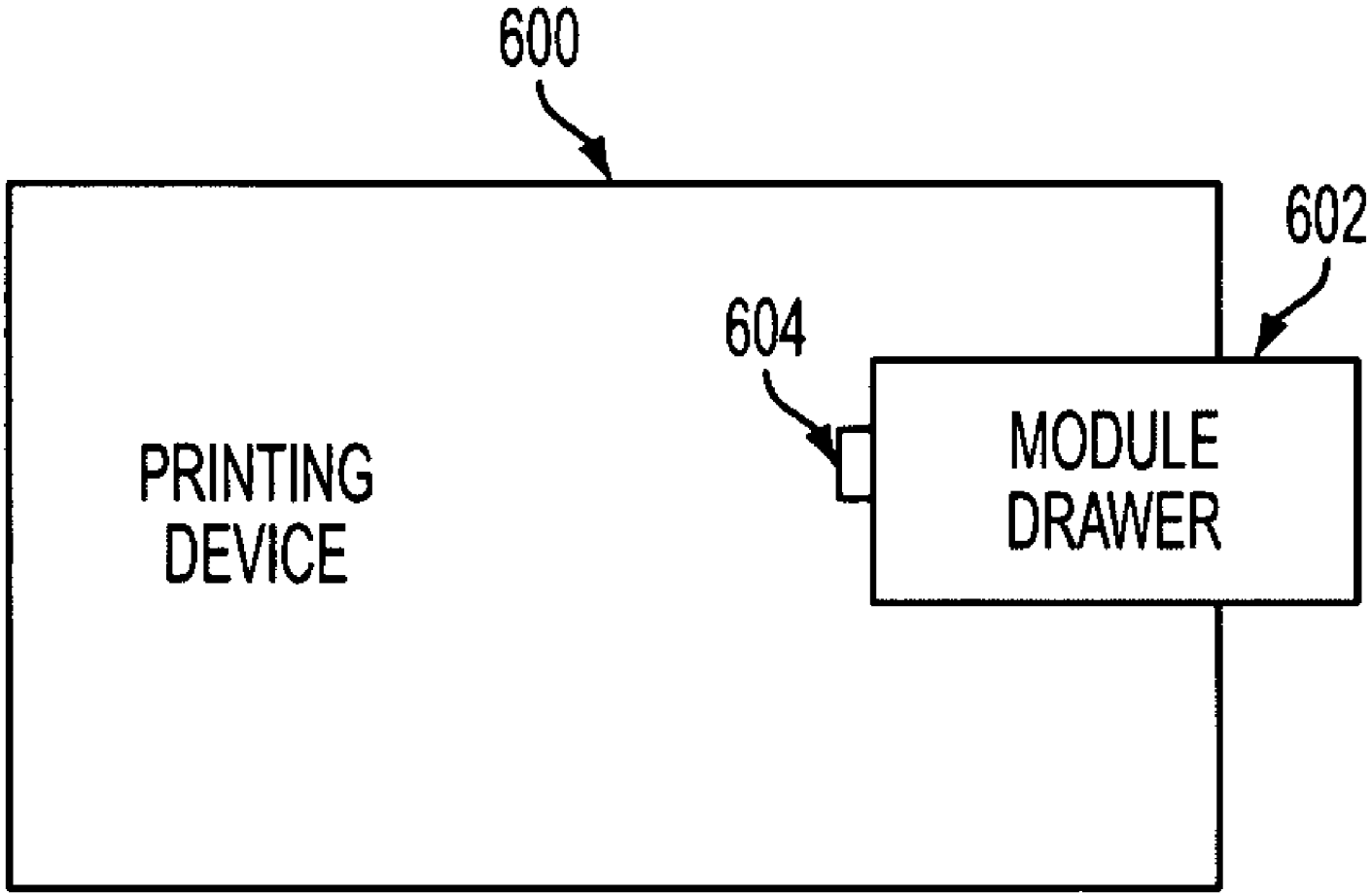
FIG. 6 is a cross-sectional view schematic diagram illustrating a printing device incorporating the flexible bracket latch mechanism according to embodiments herein.

As shown in FIG. 6, the latch structure discussed above with respect to FIG. 2 could be utilized within a printing device (such as the printing device discussed below with respect to FIG. 7) because printing devices are usually subjected to a large amount of internal contamination. The printing device is shown as item 600, a module drawer is shown as item 602, and the latch structure of FIGS. 2-5 is shown as item 604 in FIG. 6. The module drawer 602 could contain any type of module (such as any of the internal devices shown below in FIG. 7) and could include a toner storage module, paper storage module, developer module, finisher module, photoreceptor module etc.

The word "printer" or "image output terminal" as used herein encompasses any apparatus, such as a digital copier, bookmaking machine, facsimile machine, multi-function machine, etc. which performs a print outputting function for any purpose. The embodiments herein specifically applied to electrostatic and xerographic devices. The details of printers, printing engines, etc. are well-known by those ordinarily skilled in the art and are discussed in, for example, U.S. Pat. No. 6,032,004, the complete disclosure of which is fully incorporated herein by reference.

Figure 7:
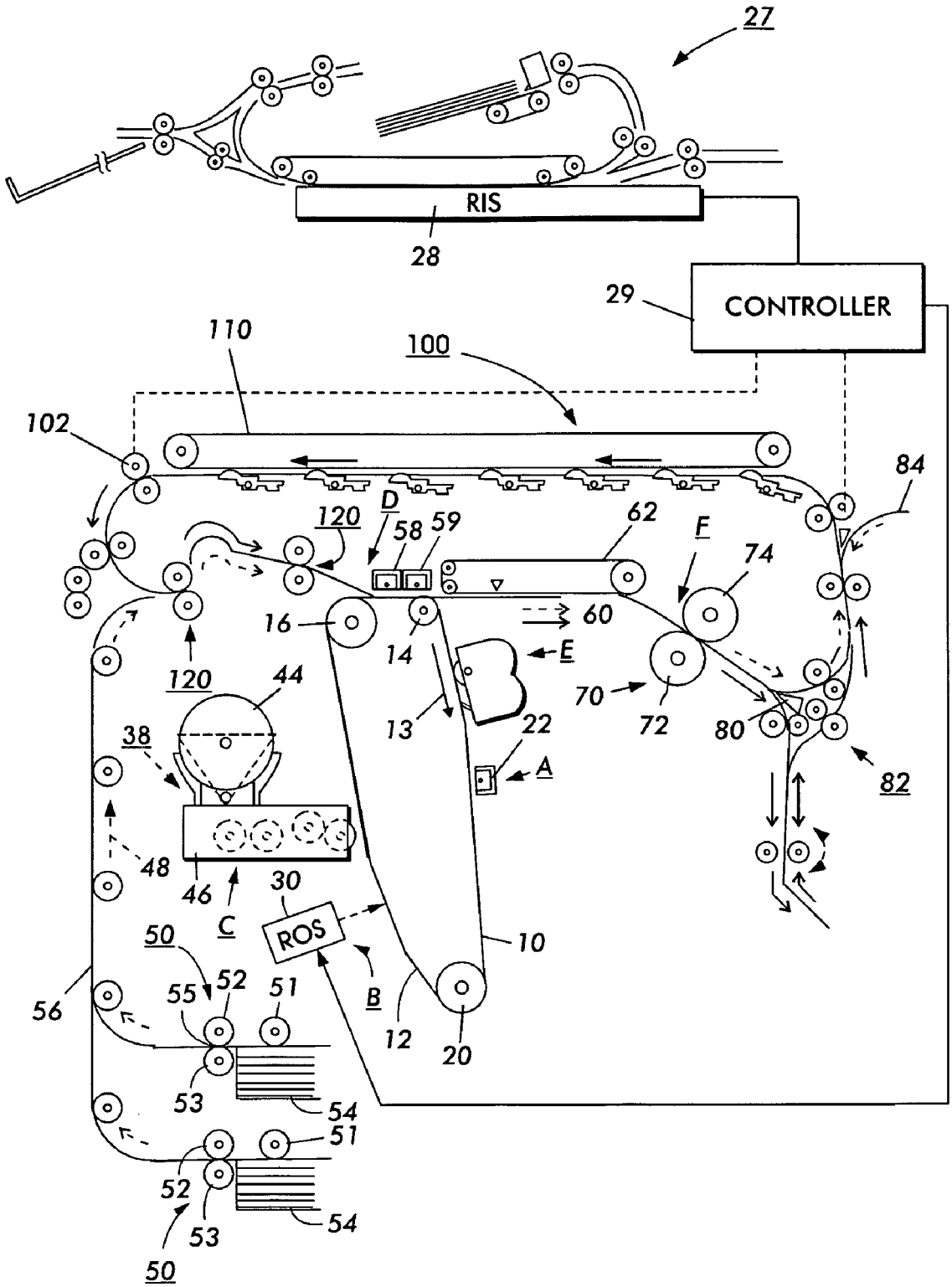
FIG. 7 is a cross-sectional view schematic diagram illustrating a printing device incorporating the flexible bracket latch mechanism according to embodiments herein.

For example, FIG. 7 schematically depicts an electrophotographic printing machine that is similar to one described in U.S. Pat. No. 6,032,004. It will become evident from the following discussion that the present embodiments may be employed in a wide variety of devices and is not specifically limited in its application to the particular embodiment depicted in FIG. 7. Once again, any of the internal devices discussed in FIG. 7 could be held within the module drawer 602, shown in FIG. 6.

Referring to FIG. 7, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 7 schematically illustrates an electrophotographic printing machine which generally employs a photoconductive belt 10. The photoconductive belt 10 can be made from a photoconductive material coated on a ground layer, which, in turn, can be coated on an anti-curl backing layer. Belt 10 moves in the direction of arrow 13 to advance successive portions sequentially through the various processing stations disposed about the path of movement thereof. Belt 10 can be entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which can be transmitted to a modulated output generator, for example the raster output scanner (ROS), indicated generally by reference numeral 30. The ESS 29 can be a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon minor blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 7, after the electrostatic latent image is developed, the toner powder image present on belt 10 advances to transfer station D. A print sheet 48 can be advanced to the transfer station, D, by a sheet feeding apparatus, 50. The sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. The fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll can be internally heated by a quartz lamp (not shown). Release agent, stored in a reservoir (not shown), can be pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller 29 can be a programmable microprocessor which controls all machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Therefore, embodiments herein use a flexible bracket to eliminate sliding surfaces within latches. The structures described herein are especially useful with latches that find application in highly contaminated environments, such as those environments experienced within printing devices. The flexible brackets described herein create a gap between surfaces that would otherwise slide against each other; yet the flexible brackets allow parts that need to move to have a sufficient movement to perform their intended function. Further, the embodiments described herein allow the flexible bracket to provide some of the latching force required, thereby allowing the biasing device that is used to create the latching force to be smaller, less expensive, lighter, etc.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the invention should not be implied or imported from any above example as limitations to any particular order, number, position, size, shape, angle, color, or material.

What is claimed is:

1. A latch apparatus comprising:

a latch base;

at least one flexible bracket connected to said latch base; and a latch frame connected to said flexible bracket, said flexible bracket connecting said latch frame to said latch base, said latch frame having a longitudinal axis, said flexible bracket having a shape allowing said flexible bracket to have greater flexibility in a first direction parallel to said longitudinal axis relative to a second direction substantially perpendicular to said first direction, and said flexible bracket maintaining a gap between said latch base and said latch frame and preventing said latch base from contacting said latch frame.

2. The apparatus according to claim 1, said shape of said flexible bracket comprising a ribbon of flexible material having four equally spaced 90 degree bends.

3. The apparatus according to claim 2, said ribbon of flexible material having a width approximately at lease 10 times greater that a thickness of said ribbon of flexible material.

4. The apparatus according to claim 1, said flexible bracket comprising one of a metal, an alloy, a polymer, a plastic, and a rubber.

5. The apparatus according to claim 1, said flexible bracket flexing in said first direction when said latch frame moves relative to said latch base.

6. The apparatus according to claim 1, said flexible bracket biasing a relative position between said latch base and said latch frame to a predetermined centralized position.

7. The apparatus according to claim 1, further comprising a catch connected to said latch frame, said catch limiting movement of said latch frame relative to said latch base.

8. A latch apparatus comprising:

a latch base;

at least one flexible bracket connected to said latch base;

a latch frame connected to said flexible bracket, said flexible bracket connecting said latch frame to said latch base;

connectors that connect said flexible bracket to said latch frame and connect said flexible bracket to said latch base, said connectors preventing an outer surface of said flexible bracket from moving along a surface of said latch frame and preventing said outer surface of said flexible bracket from moving along a surface of said latch base; and at least one biasing member connected to said latch base and connected to said latch frame;

said latch frame having a longitudinal axis, said biasing member biasing said latch frame in a first direction parallel to said longitudinal axis, said flexible bracket having a shape allowing said flexible bracket to have greater flexibility in said first direction relative to a second direction substantially perpendicular to said first direction, and said flexible bracket maintaining a gap between said latch base and said latch frame and preventing said latch base from contacting said latch frame.

9. The apparatus according to claim 8, said shape of said flexible bracket comprising a ribbon of flexible material having four equally spaced 90 degree bends.

10. The apparatus according to claim 9, said ribbon of flexible material having a width approximately at lease 10 times greater that a thickness of said ribbon of flexible material.

11. The apparatus according to claim 8, said flexible bracket comprising one of a metal, an alloy, a polymer, a plastic, and a rubber.

12. The apparatus according to claim 8, said flexible bracket flexing in said first direction when said latch frame moves relative to said latch base.

13. The apparatus according to claim 8, said flexible bracket biasing a relative position between said latch base and said latch frame to a predetermined centralized position.

14. The apparatus according to claim 8, further comprising a catch connected to said latch frame, said catch limiting movement of said latch frame relative to said latch base.

15. A printing device comprising:

a module;

a drawer connected to and supporting said module;

a latch apparatus connected to said drawer, said latch apparatus comprising:

a latch base;

at least one flexible bracket connected to said latch base; and a latch frame connected to said flexible bracket, said flexible bracket connecting said latch frame to said latch base, said latch frame having a longitudinal axis, said flexible bracket having a shape allowing said flexible bracket to have greater flexibility in a first direction parallel to said longitudinal axis relative to a second direction substantially perpendicular to said first direction, and said flexible bracket maintaining a gap between said latch base and said latch frame and preventing said latch base from contacting said latch frame.

16. The printing device according to claim 15, said shape of said flexible bracket comprising a ribbon of flexible material having four equally spaced 90 degree bends.

17. The printing device according to claim 16, said ribbon of flexible material having a width approximately at lease 10 times greater that a thickness of said ribbon of flexible material.

18. The printing device according to claim 15, said flexible bracket comprising one of a metal, an alloy, a polymer, a plastic, and a rubber.

19. The printing device according to claim 15, said flexible bracket flexing in said first direction when said latch frame moves relative to said latch base.

20. The printing device according to claim 15, said printing device comprising one of an electrostatographic and a xerographic printing device.

* * * * *